US005404011A

United States Patent [19]

Wells et al.

[11] Patent Number: 5,404,011

[45] Date of Patent: Apr. 4, 1995

[54] MS$^n$ USING CID

[75] Inventors: Gregory J. Wells, Fairfield; Mingda Wang, Walnut Creek, both of Calif.

[73] Assignee: Varian Associates, Inc., Palo Alto, Calif.

[21] Appl. No.: 121,844

[22] Filed: Sep. 15, 1993

Related U.S. Application Data

[63] Continuation-in-part of Ser. No. 890,996, May 29, 1992, Pat. No. 5,302,826.

[51] Int. Cl.$^6$ ..... H01J 49/42

[52] U.S. Cl. ..... 250/282; 250/291

[58] Field of Search ..... 250/282, 290, 291, 292

[56] References Cited

U.S. PATENT DOCUMENTS

| | | | |
|---|---|---|---|
| 4,736,101 | 4/1988 | Syka et al. | 250/282 |
| 5,128,542 | 7/1992 | Yates et al. | 250/282 |
| 5,200,613 | 4/1993 | Kelley | 250/282 |
| 5,206,509 | 4/1993 | McLuckey et al. | 250/282 |

*Primary Examiner*—Jack I. Berman

*Attorney, Agent, or Firm*—Gerald M. Fisher

[57] ABSTRACT

A method for using a QIT and for performing collisionally induced disassociation MS$^n$ experiments by scanning the trap potential sequentially so that the field first experiences a secular frequency of a selected parent ion and then the secular frequency of a CID produced daughter ion and then the secular frequency of a granddaughter ion and so on for each secular frequency of each progeny ion in descending mass order.

23 Claims, 7 Drawing Sheets

$MS^n$ USING CID

RELATED INVENTION

This invention is a continuation-in-part of the patent application belonging to the same assignee, Varian Case No. 92-14, "Quadrupole Trap Improved Technique for Collision Induced Disassociation for MS/MS Processes, inventor Gregory J. Wells, Ser. No. 07/890,996 filed May 29, 1992, now U.S. Pat. No. 5,302,826, which invention is incorporated herein by reference.

FIELD OF THE INVENTION

This invention relates to an improved method of using a quadrupole ion trap (QIT) for multigeneration collision induced dissociation (CID).

BACKGROUND OF THE INVENTION

In a 1952 paper by Paul, et al, the QIT and a slightly different device called the quadrupole mass spectrometer (QMS) were first disclosed. Mass spectrometers were known earlier but the QMS was the first mass spectrometer which did not require the use of a large magnet but used radio frequency fields instead for separation of ions of a sample, i.e., performing mass analysis. Massspectrometers are devices for making precise determinations of the constituents of a material by providing separations of all the different masses in a sample according to their mass (m) to charge (e) ratio (m/e). Mass spectrometers need to first disassociate/fragment a sample into charged atoms, i.e., ions, or molecularly bound group of atoms and then employ some mechanism for determining the M/e ratio of those fragments.

The QMS mechanism for separating ions relies on the fact that within a specifically shaped structure, radio frequency fields can be made to interact with an ion within the structure so that the resultant force on the ion is a restoring force which causes certain ions to oscillate about some referenced position. The QIT is capable of providing restoring forces on selected ions in three orthogonal directions. This is the reason that it is called a trap. Ions so trapped can be retained for relatively long periods of time which enables various operations and experiments on selected ions.

By changing one of the QIT parameters, it is possible to cause consecutive values of m/e of stored ions in the trap to become unstable and to pass those ions into a detector. The detected ion current signal intensity, as a function of the scan parameter, is the mass spectrum of the trapped ions.

Techniques are available to isolate an ion by scanning the QIT and to eject all ions except ions of a certain selected m/e value. If those isolate ions are considered a "parent", and they are further disassociated by some technique, "daughter" ions are formed which can be analyzed, or a single daughter ion can be isolated and further "daughters" obtained. This is known as MS/MS or $MS^n$ spectroscopy.

The preferred technique for further ion disassociation is a gentle ionization method called Collision Induced Disassociation (CID). The usual technique to obtain CID as described by Syka in U.S. Pat. No. 4,736,101 is to cause the ion to be excited at the secular frequency for the selected mass to increase the translational motion and decrease the mean time between collisions. According to the Syka technique, a signal at the secular frequency is applied to the end caps of the QIT. The kinetic motion energy is translated into internal energy on collision which results in gentle daughter ion fragmentation.

The Syka technique has a problem because it is extremely difficult to know the exact secular frequency required in advance to gently excite a particular ion. This is due to space charge effects in the trap relating to the number of ions and the molecular weight of the trapped ions and due to slight mechanical errors in the electrode shapes.

In the invention incorporated herein by reference, the inventors modulated the RF trapping field voltage at the same time that the "tickle" approximate secular frequency was supplied in order to provide sufficient frequency excitation coincident with the secular frequency to induce CID.

Another approach is to apply a continuum of CID frequencies to the QIT end caps to excite each generation of ions as disclosed by McLuckey, "*Collisional Activation with Random Noise in Ion Trap*," Anal. Chem. 64, 1992, 1455-1460. Typically, noise excitation is the broad band frequency source. The problem with this approach is that it causes the ions, both the parent and the daughter ions to disassociate without any control over the power absorbed by any particular ion.

Another broad band excitation technique is described by Yates, et at, at 39th MAS Conference Report on Mass Spectroscopy and Allied Topics, in a paper entitled "*Resonant Excitation for GC/MS/MS in the 0IT via Frequency Assignment Prescans and Broadband Excitation*", p. 132. This technique applied a 10 KHz band width described orally as a synthesized inverse FT time domain waveform to the QIT end caps so that the waveform has a frequency domain representation comprising a band of uniform intensity equally spaced frequencies up to $\pm 5$ KHz about a center frequency at the calculated theoretical secular frequency.

The difficulty with this Yates approach is that the noise amplitude and duration can be used to establish the fluence (power x time) for an ion of particular mass but with this technique the other ions cannot be optimized. Over excitation can cause ejection of the selected ion rather than disassociation. This ejection effect is amplified where ions are formed far from QIT center and absorb energy from noise immediately without being damped back to the QIT center.

SUMMARY OF THE INVENTION

It is the object of this invention to provide a QIT method and apparatus for improved qualitative and quantitative trace analysis by providing a new more convenient method to perform MS/MS or $MS^n$ analysis.

It is a further object to enable a convenient "finger printing" qualitative analysis of a sample by providing a single spectrum of an unknown sample showing parent and all daughter ions produced by CID.

A further object of this invention is to provide rapid and automatic sequential CID of a parent, and then CID of first daughter ions, and then CID of second daughter ions until all daughters ad infinitum from the family are disassociated.

DETAILED DESCRIPTION OF THE INVENTION

Figure 1:
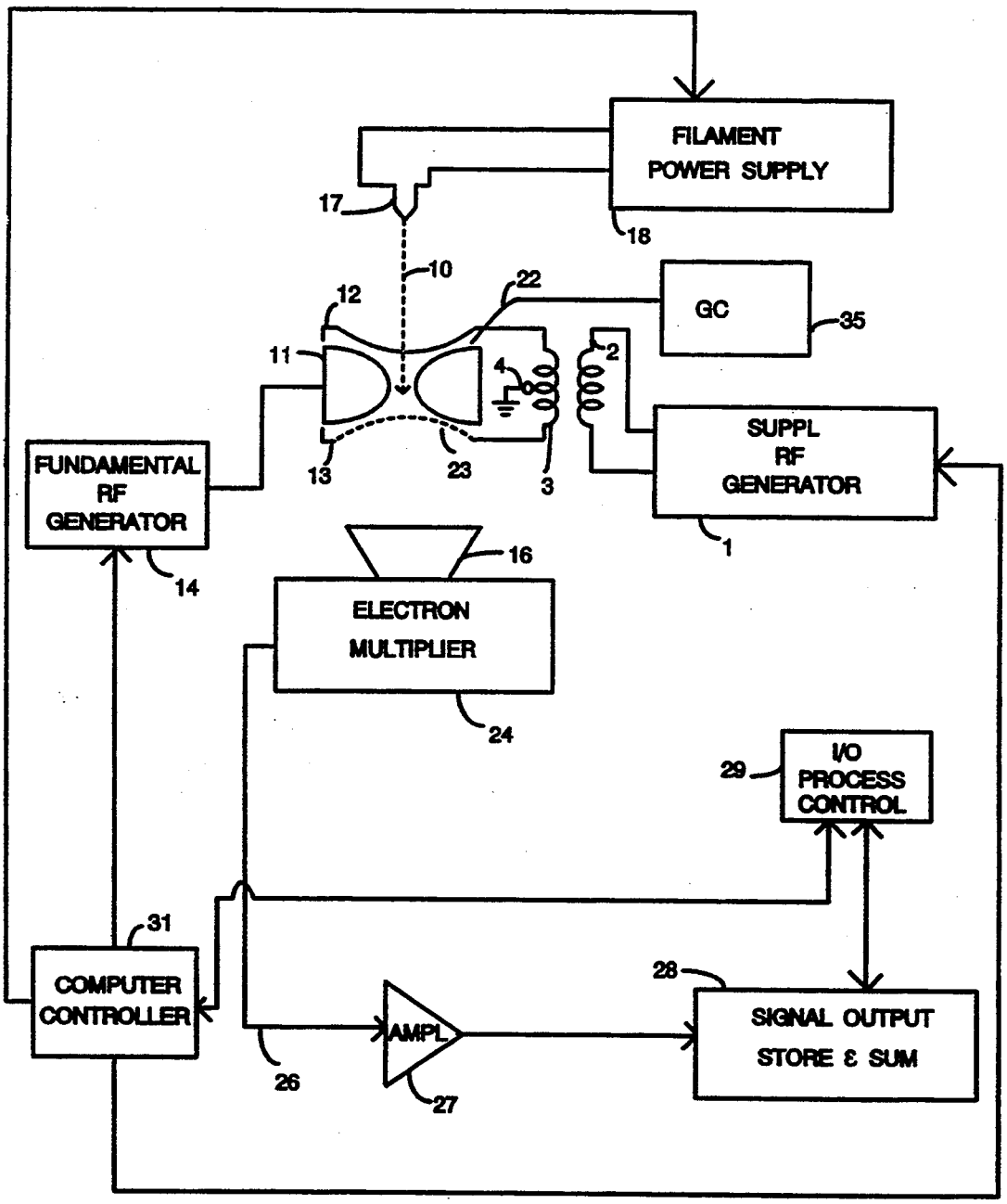
FIG. 1 is a block diagram of a QIT used in the invention.

With reference to FIG. 1, the quadrupole ion trap (QIT) is comprised of the ring electrode 11 of hyperbolic shape. End cap electrodes 12 and 13, also of hyperbolic shape are shown. The ring electrode is connected to Fundamental RF Generator 14 and transformer secondary winding is connected to end caps 12 and 13. In this configuration, the secondary winding is shown center tapped 4 to ground. The transformer primary winding 2 is connected to the Supplemental RF Generator 1. The Supplemental RF Generator 1 is to provide excitation to induce the gentle collisional induced disassociation (CID) of the ions in the trap as required to carry out MS/MS experiments (or $MS^n$) involving CID excitation of a parent and its daughter ions. The sample material to be analyzed is shown, for example, in this instance as coming from a gas chromatograph (GC) 35 and being introduced into the QIT via a tubing 22. The electron bombardment source 17 under control of the Filament Power Source 18 is used to obtain high energy ionization of the gas in the trap by high velocity electron bombardment 10.

The end cap 13 has perforations 23 therein for permitting ions to be selectively ejected from the trap toward the capture funnel 16 of the electron multiplier. The electron multiplier provides an output signal on conductor 26 to the amplifier 27 which is connected to Store and Integrator 28.

The operator can introduce selected process control to I/O Process Control 29 station. The I/O Process Control is connected to the computer controller 31, The computer 31 controls the QIT timing and parameters process by controlling the bombardment source, Fundamental RF Generator and supplemental RF Generator.

It is known to isolate a selected ion by various techniques. The related invention, incorporated by reference herein above, describes techniques for isolating a selected ion in the trap.

To carry out the methods of this invention, after isolating the desired ion in the trap, the amplitude $V_{RF}$ of the voltage output of the Fundamental RF Generator 14 is reduced to a level which will permit trapping product ions of smaller mass than the mass of the parent ion. Fragmenting an ion will always produce lower mass ions when CID takes place. It is known that ions are retained in the trap if $q_z<0.9$. Since $$q_z \approx \frac{V_{RF}}{m}$$

it is seen that lower value mass than the parent can not be trapped unless the $V_{RF}$ is reduced.

Figure 2A:
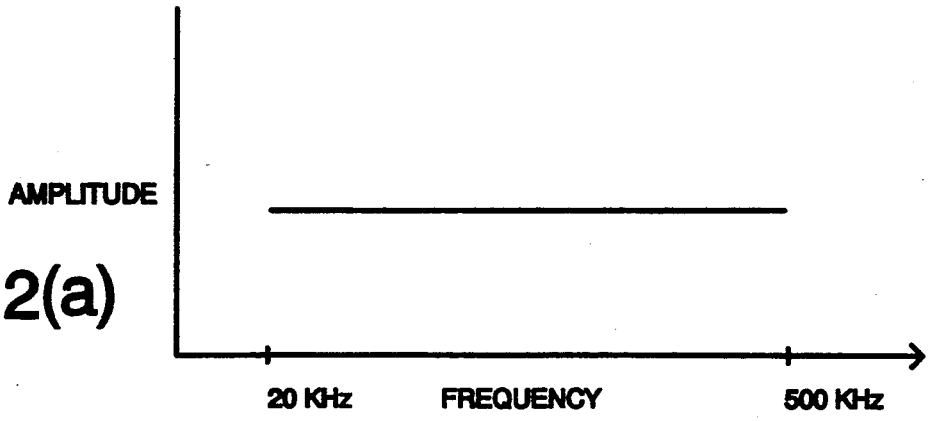
FIG. 2(*a*)–2(*c*) are illustrations of alternative scans of the frequency and amplitude of the supplemental RF generator connected to the QIT end caps.
Figure 2B:
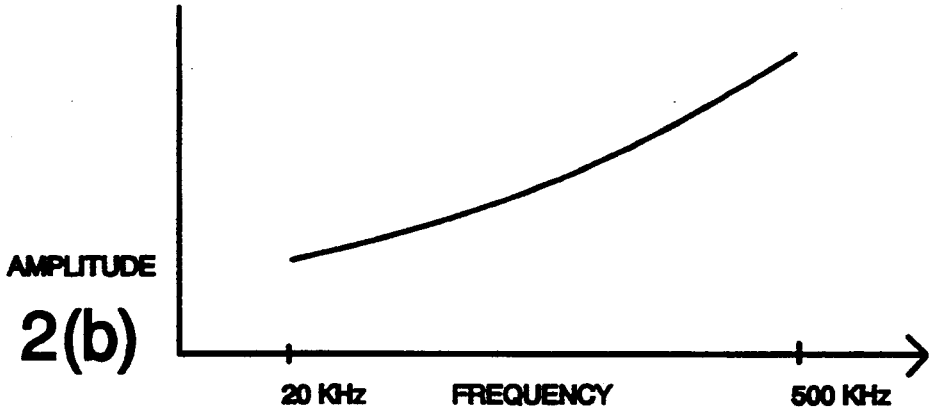
Figure 2C:
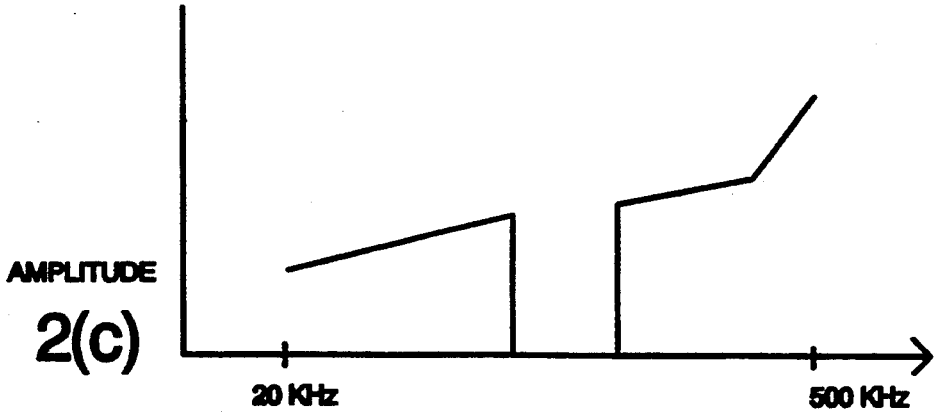

With an isolated ion in the QIT, by scanning the frequency of the supplemental RF Generator from a low toward high value as shown in FIG. 2(*a*), the secular resonance of the parent will be reached at some point. This will excite the parent ion to move in larger orbits and induce gentle disassociation called CID. The secular frequency is $W1=\frac{1}{2}\beta_z W_0$, where $\beta_z$ is a known function of $q_z$ and $a_z$. Although it is clear that it is difficult or impossible to determine $\beta_z$ in advance, it is clear that the secular frequency for the parent ion will be reached before the secular frequency of the daughter, a lower mass ion, is reached. If the amplitude of the Supplemental RF Generator voltage is large enough, we have discovered that all the parent ions in the trap will be disassociated into at least one daughter ion. We have also discovered that by reducing the amplitude of the supplement RF Generator, that the CID of the parent will be incomplete and we can retain both the non-reacted parent ions and the daughters in the trap simultaneously.

Similarly, as we continue to scan the Supplemental RF Generator in increasing frequency direction, we will next reach the secular frequency of the first daughter ions produced above and the first daughter ion will then become disassociated. As above reported, depending on the amplitude of the Supplemental RF Generator output, the disassociation may or may not be complete.

It is seen that repeating this procedure automatically permits analysis of all sequential daughter atoms without requiring prior knowledge or prior setting of a selected secular frequency. This avoids the problems related to changes in space charges and drifts in electronics. In addition, the power absorbed by each ion can be individually optimized to avoid over excitation and ion ejection from the trap. This avoids the problems related to use of broad-band noise excitation.

If the CID is complete, i.e. high value of Supplemental Generator amplitude, a new method of quantitative analysis by MS/MS is provided.

The integral of the total number of ions collected by the electron multiplier including the daughter ions from a single parent is representative of the quantitative amount of the parent ion in the sample. This is particularly useful for trace analysis.

FIG. 2(*a*) shows one alternative of Supplemental RF Generator voltage versus frequency from 20 KHz to 500 KHz. This corresponds to a mass range of 650 units to 50 units depending on the $V_{RF}$ setting. FIG. 2(*b*) and 2(*c*) also show curves of amplitude vs. frequency for alternative scanning waveforms of the Supplemental RF generator.

As the q value of an ion increases, the amplitude of the supplemental RF Generator increases to obtain equally efficient CID. Accordingly, it may be desirable to more closely track this relationship during the scanning. In addition, in FIG. 2(*c*), the amplitude could be set to zero for a particular frequency range corresponding to a particular mass range for which it is desired that there is to be no collisional excitation.

FIG. 2(*a*) to (*c*) do not indicate how these functions may vary as a function of time. It may be necessary or desirable to vary the frequency scan rate in a non-linear way in order to maintain uniform mass sensitivity of the QIT.

Figure 3:
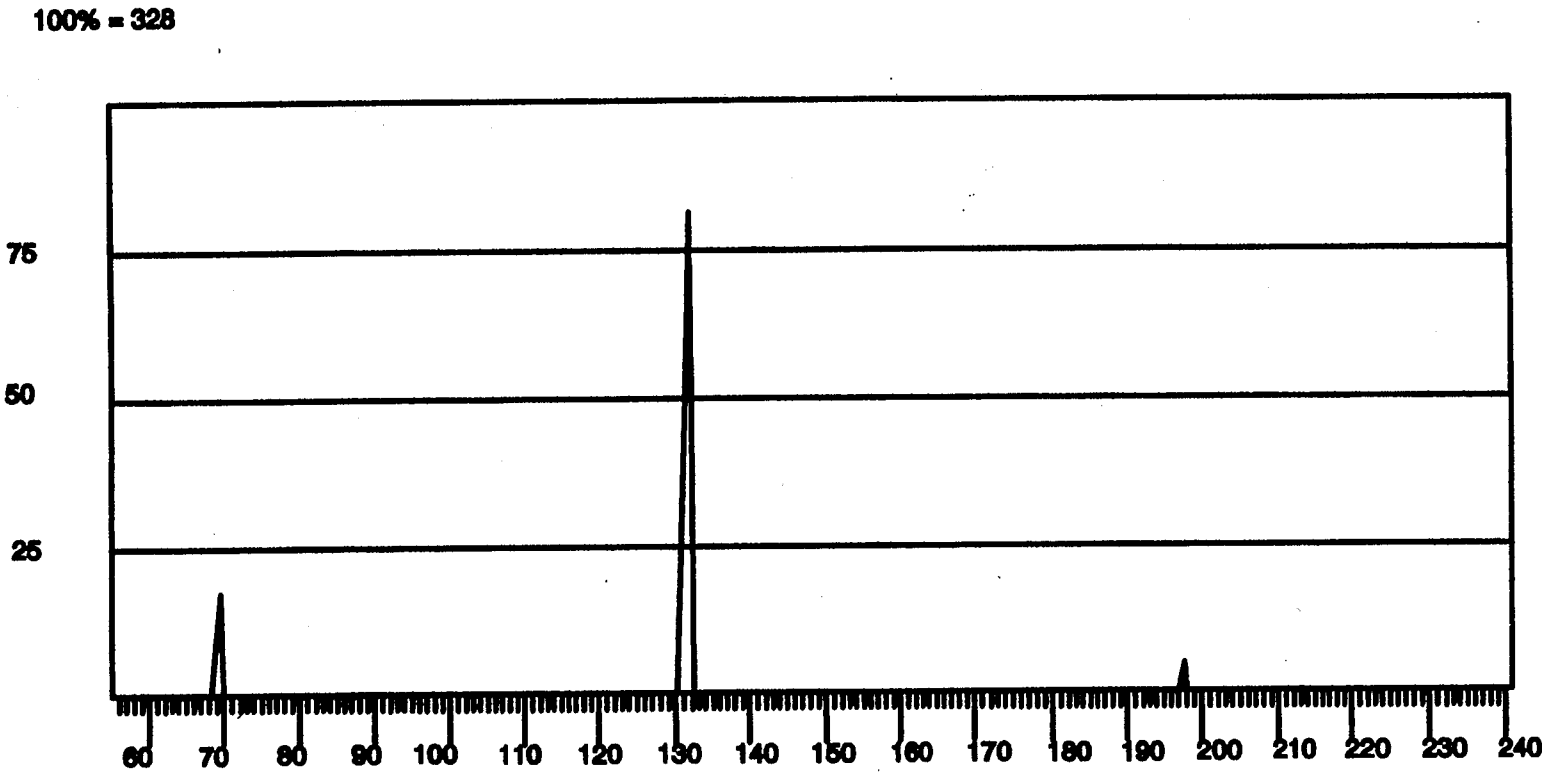
FIG. 3–FIG. 5 are illustrations of the Mass 219 CID spectrum according to the invention.
Figure 4:
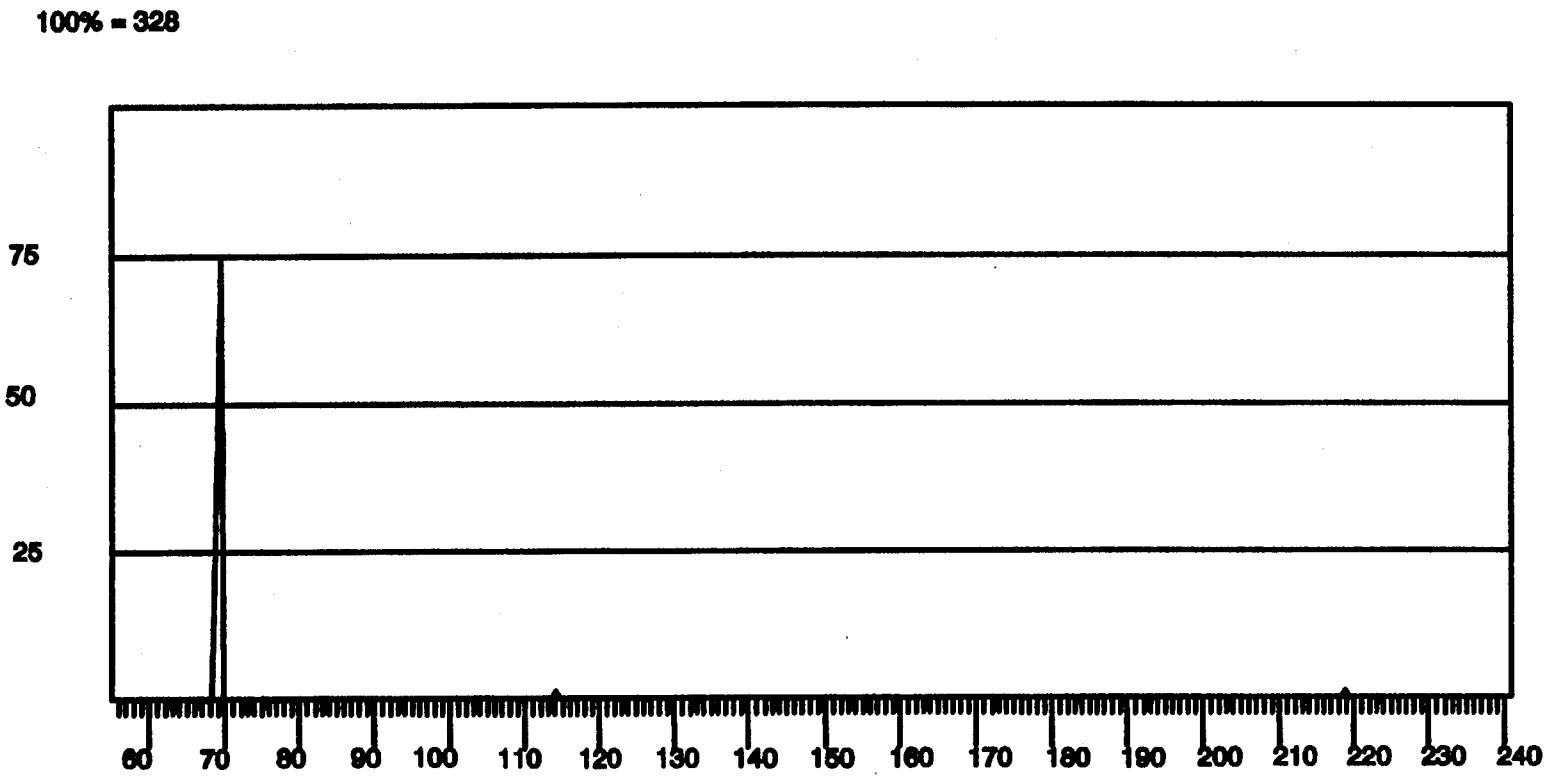

With reference to FIG. 3, we show spectra which demonstrate the advantages of our invention. Specifically, FIG. 3 shows the result of isolating the mass 219 ion of PFTBA, and then reducing the Fundamental RF voltage and then and sweeping the Supplemental RF Generator 1 from 88 KHz to 92 KHz with a 1.3 volt fixed amplitude of FIG. 2(*a*). The scan was accomplished linearly in 60 milliseconds. It can be seen that almost all the 219 ion is disassociated into 131 mass daughter ions. The daughters of the 131 mass ion can be seen in a small amount at mass 69. In FIG. 4, the above experiment of FIG. 3 is repeated except that here the sweep of the Supplemental RF Generator is increased from 88 KHz to 145 KHz. In this FIG. 4, it can be seen that essentially all the 131 daughter ions are disassociated into mass 69 granddaughter ions. Accordingly, FIG. 3 and FIG. 4, illustrate in two step fashion for illustrative purposes the benefits of the invention in carrying out sequential/tandem CID on a parent ion.

Figure 5:
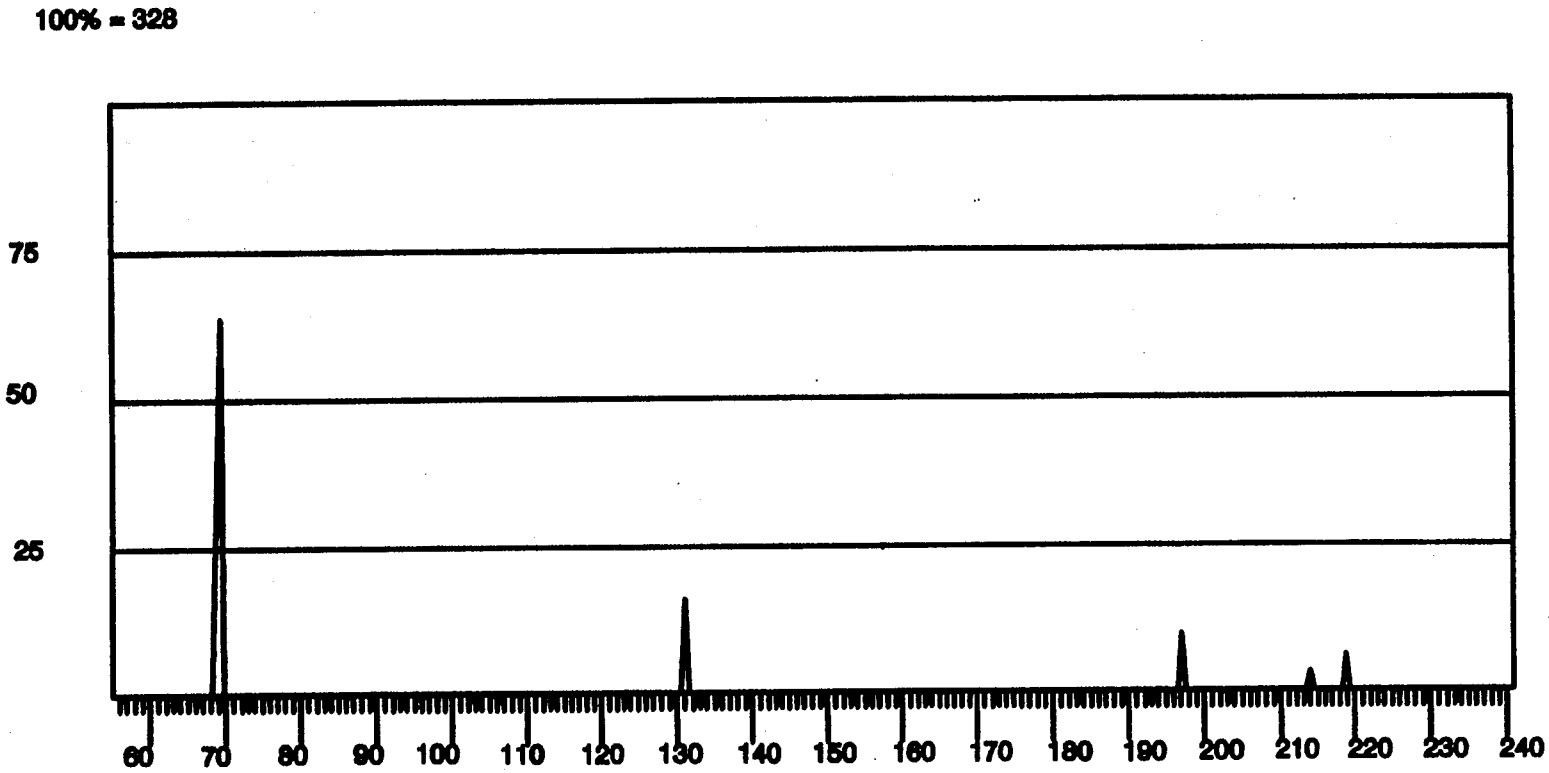

As mentioned earlier, it is also possible to reduce the amplitude of the Supplemental Frequency Generator, so that less than all of the ions are disassociated. This procedure provides a unique technique to unambiguously view all the family ions in one spectra. With reference to FIG. 5, the experiment of FIG. 4 is repeated another time, but this time the amplitude of the Supplemental Frequency Generator output voltage is set to 0.96 volts. Note that the experiment of FIG. 5 provides a spectrum including every member of the family including the parent 219 mass ion, the daughter 131 mass ion and the granddaughter 69 mass ion.

Method I

The two experiments of FIG. 5 and FIG. 4 can be run in close sequence. The first run could be like FIG. 5 to provide qualitative information since all constituents of the parent would be seen and each daughter adds to the "fingerprint" of the parent. Next, the FIG. 4 experiment could be run to qualitatively determine the concentration of the parent ion. Since essentially all the parent ions have been reduced to the granddaughter ions, using a higher voltage for CID, when the granddaughter ions at mass 69 are scanned out into the electron multiplier, the charge collected can be conveniently converted to a signal which can be integrated and which very accurately represents the concentration of the parent ion in the original sample.

Method II

Another embodiment of the methods of this invention enables the operator of the QIT to obtain the sequential CID excitation of the parent ion and each of its progeny immediately after the progeny is produced. Specifically with reference to FIG. 6(*a*) are illustrated, the secular frequencies of a hypothetical Parent ion (P) and the first progeny (G1) and its progeny (G2) and its progeny (G3).

Figure 6:
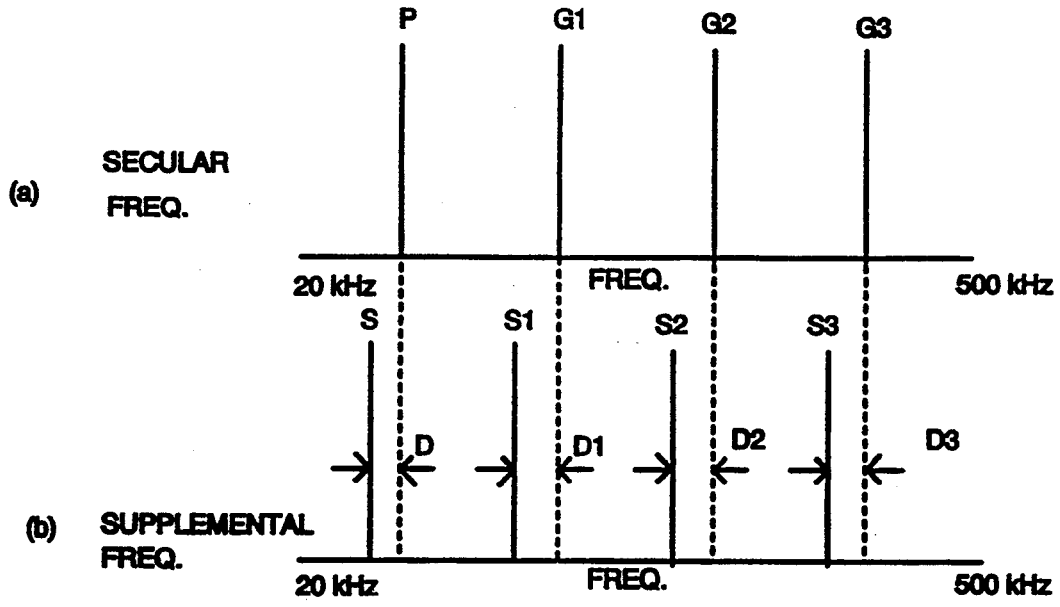
FIG. 6 is an explanatory diagram of another method involving Fundamental RF generator voltage scanning.

FIG. 6(*b*) is located immediately beneath FIG. 6(*a*) and aligned therewith. FIG. 6(*b*) shows fixed and displaced frequencies $S_g$, $S_1$, $S_2$, and $S_3$ provided by the Supplemental RF Generator 1 for this alternative method II, Method II involves the scan of the voltage of the Fundamental RF Generator while the Supplemental RF Generator 1 is fixed as shown in FIG. 6(*b*).

When the parent ion P in FIG. 6(*a*) is disassociated by the Supplemental RF Frequency S, which occurs upon the scan of the voltage of Fundamental RF Generator 14, this P ion becomes fragmented primarily into an ion having secular frequency G1. Modulation of the voltage of the Fundamental RF Generator as described in the parent co-pending application can also be employed during the scan of the voltage of the Fundamental RF Generator or the scan of the Supplemental Generator. Upon further scan of the voltage of the Fundamental RF Generator, the, secular frequency G1 of the daughter shifts until it becomes equal to S2 where it becomes CID excited, resulting in a new ion having a secular frequency G2. The operation is similar, for G2 and G3 by interaction with the supplemental frequencies S2 and S3. Alternatively, $S_g$, $S_1$, $S_2$ . . . $S_3$ may be switched on sequentially while the voltage of the fundamental RF is fixed or periodically modulated . The benefits are realized, as long as the proper supplemental frequency is on when the specific daughter is disassociated.

Figure 7:
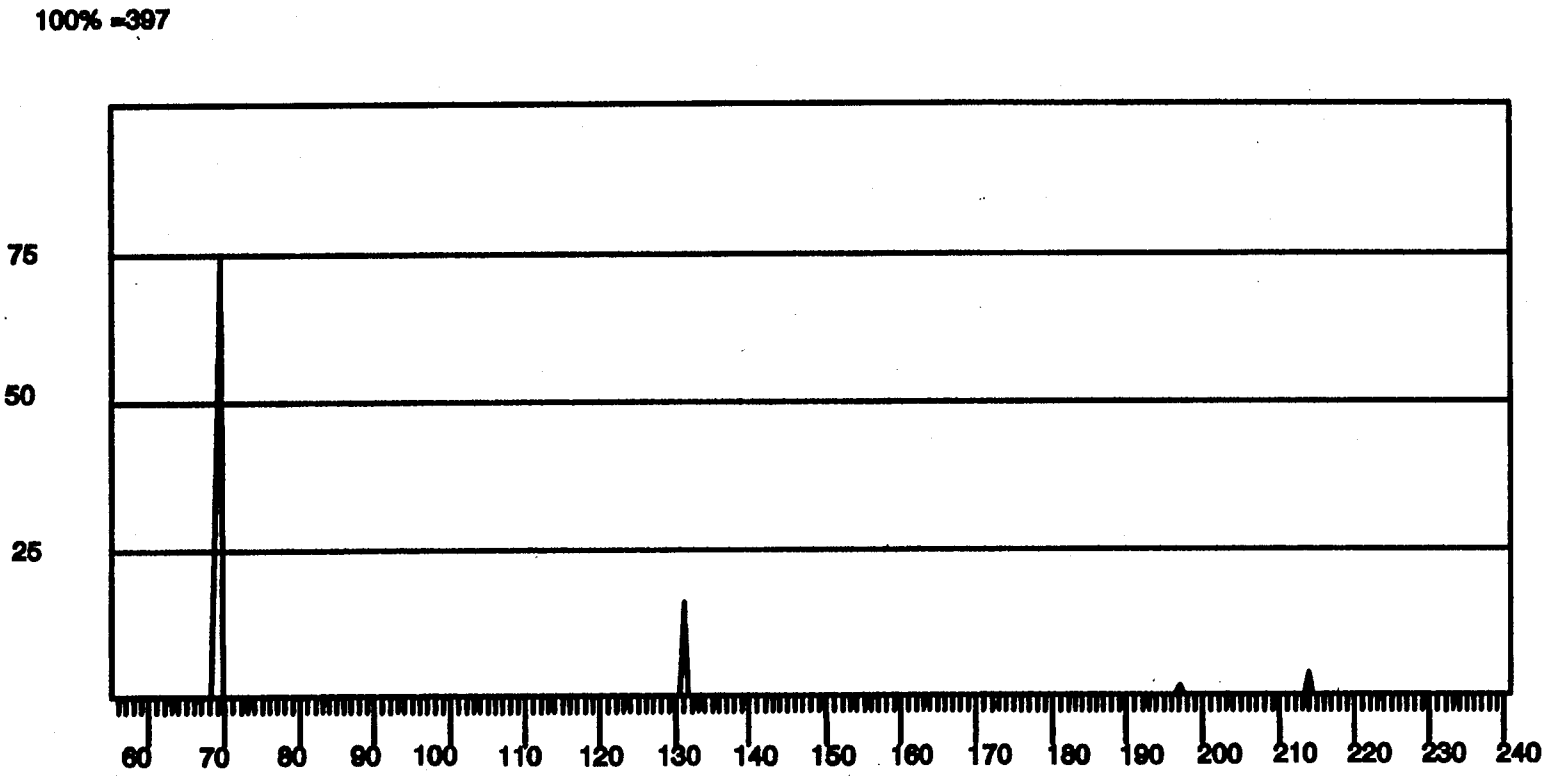
FIG. 7 is a QIT spectra obtained using the method of FIG. 6.

FIG. 7 is a spectra of the 219 mass ion from PFTBA using Method II for MS/MS/MS employing the linear scan in Fundamental RF Generator voltage from DAC values of 340 to 320 in 30 msec. which corresponds to 3 mass units. The fixed supplemental frequencies are each displaced toward lower frequency than the secular frequency of the parent or progeny so that as the RF Fundamental is scanned, each of the parent and generated progeny will be shifted and come into resonance with the Supplemental RF Generator outputs. For the Supplemental RF Generator amplitude at 2.4 volts, the Daughter at 131 is not completed ionized into mass 69. Thus, FIG. 7 is useful as a technique to obtain the "fingerprint" of the sample.

The invention herein has been described with respect to specific figures of this application. It is not my intention to limit the invention to any specific embodiment but the scope of the invention should be determined by the claims. With this in view,

What is claimed is:

1. In a method for performing collisionally induced disassociation (CID) of a parent and progeny ions thereof in a quadrupole ion trap (QIT) having a ring and end cap electrodes, including the steps of:

(a) applying RF trapping voltages $V_{RF}(t)$ to said ring electrode at RF frequency $W_0$, applying supplemental voltages to said end caps, (c) adjusting said RF trapping voltage level and sequencing said RF trapping voltage and said supplementary voltages to isolate a selected ion in said QIT, (d) after isolating a selected ion, modulating said voltages so that the potential field has a frequency component which equals the secular frequency of said isolated ion,

THE IMPROVEMENT COMPRISING wherein the step of modulating said voltages includes scanning one of said voltages so that the potential field sequentially has a frequency component which, in time sequence, first reaches and equals the secular frequency of said parent ion and then reaches and equals the secular frequency of each of said progeny ions in descending mass order.

2. The method of claim 1 wherein said step of modulating said voltages and said step of scanning one of said voltages includes scanning the frequency of said supplemental voltages applied to said end caps while holding the RF Trapping voltage constant.

3. The method of claim 2 wherein said step of scanning the frequency of said supplemental voltage includes scanning over frequencies within the range 20 KHz to 500 Fritz.

4. The method of claim 2 wherein the step of scanning the supplemental voltages includes scanning the frequency and maintaining the amplitude constant at each frequency.

5. The method of claim 4 wherein the step of scanning the frequency of said supplemental voltages includes providing the amplitude of said supplemental voltage at a value for a short time so that the product of time and amplitude is less than the fluence necessary to elisassociate all of the parent and all of the daughter ions whereby the fingerprint spectra is obtained which contains ions at each of the mass value of the parent and all its fragments.

6. The method for determining the qualitative fingerprint analysis of a sample by performing the steps of claim 4 to determine the qualitative analysis.

7. The method of claim 2 wherein the step of scanning the supplemental voltage includes scanning the frequency and programmably modifying the amplitude of said supplemental voltage as a function of the frequency.

8. The method of claim 7 wherein said amplitude of said supplemental voltage is programmed to be at zero value for a preselected number of frequencies.

9. The method of claim 2 wherein the step of scanning the frequency of said supplemental voltages includes providing the amplitude of said supplemental voltage at a value for a time long enough so that the product of time and amplitude is larger than the fluence necessary to disassociate all of the parent and daughter ions except for the final progeny ions.

10. The method of for determining the qualitative and quantitative fingerprint analysis of a sample by performing the steps of claim 9 to determine the quantity of the said selected ion in said sample.

11. The method of claim 1 wherein said step of modulating said voltages and said step of scanning one of said voltages includes scanning the frequency of said supplemental voltages applied to said end caps while periodically modulating said RF trapping voltage.

12. The method of claim 11 wherein said step of scanning the frequency of said supplemental voltage includes scanning over frequencies within the range 20 KHz to 500 KHz.

13. The method of claim 11 wherein the step of scanning the supplemental voltages includes scanning the frequency and maintaining the amplitude constant at each frequency.

14. The method of claim 13 wherein the step of scanning the frequency of said supplemental voltages includes providing the amplitude of said supplemental voltage at a value for a short time so that the product of time and amplitude is less than the fluence necessary to disassociate all of the parent and all of the daughter ions whereby the fingerprint spectra is obtained which contains ions at each of the mass value of the parent and all its fragments.

15. The method for determining the qualitative fingerprint analysis of a sample by performing the steps of claim 13 to determine the qualitative analysis.

16. The method of claim 11 wherein the step of scanning the supplemental voltage includes scanning the frequency and programmably modifying the amplitude of said supplemental voltage as a function of the frequency.

17. The method of claim 16 wherein said amplitude of said supplemental voltage is programmed to be at zero value for a preselected number of frequencies.

18. The method of claim 11 wherein the step of scanning the frequency of said supplemental voltages includes providing the amplitude of said supplemental voltage at a value for a time long enough so that the product of time and amplitude is larger than the fluence necessary to disassociate all of the parent and daughter ions except for the final progeny ions.

19. The method of for determining the qualitative and quantitative fingerprint analysis of a sample by performing the steps of claim 18 to determine the quantity of the said selected ion in said sample.

20. The method of claim 1 wherein said step of scanning one of said voltages includes scanning the amplitude of the RF Fundamental Frequency voltage while simultaneously or sequentially providing a plurality of supplemental voltages of different fixed frequencies, said plurality of supplemental voltage including a discrete frequency located near the secular frequency of the parent ion and a different discrete frequency located near but not at the secular frequency of each daughter ion and wherein the amplitude of each said different discrete frequencies is individually adjustable.

21. The method of claim 20 wherein said scanning the amplitude of said Fundamental RF Generator includes scanning over several mass units and the said discrete frequencies are offset so that each discrete frequency comes into resonance with only one parent or one daughter as said Fundamental RF Generator voltage is continuously scanned in one direction.

22. A method of using a QIT employing a Fundamental RF Generator waveform on its ring electrode and Supplemental RF Generator waveforms on its end caps for qualitative and quantitative trace analysis of a sample by performing $MS^n$ analysis by isolating a single mass ions of said sample and by gently fragmenting said single mass ions, by CID to obtain daughter ions and then fragmenting the said daughter ions by CID to obtain granddaughter ions and then fragmenting said granddaughter ions to great granddaughter ions and so on for all ion progeny,

THE IMPROVEMENT COMPRISING (a) performing a $MS^n$ experiment on said sample using a CID excitation fluence of sufficient value to disassociate each daughter species completely, but gentle enough not to cause ejection of said ions whereby all the parent and daughter ions are disassociated to a single progeny ions;

(b) scanning out all the ions in said trap and integrating the total ion charge to obtain a signal accurately representative of the concentration of said parent ion in said sample.

23. A method of using a QIT employing a Fundamental RF Generator waveform on its ring electrode and Supplemental RF Generator waveforms on its end caps for qualitative and quantitative trace analysis of a sample by performing $MS^n$ analysis by isolating a single mass ions of said sample and by gently fragmenting said single mass ions by CID to obtain daughter ions and then fragmenting the said daughter ions by CID to obtain granddaughter ions and then fragmenting said granddaughter ions to great granddaughter ions and so on for all ion progeny,

THE IMPROVEMENT COMPRISING (a) performing a first $MS^n$ experiment on said sample with an insufficient CID fluence to completely disassociate all the ions of any of the parent or progeny species and scanning out all ions trapped in order to obtain a qualitative fingerprint spectra containing peaks at the mass of the parent of and each of its progeny; and (b) performing a second $MS^n$ experiment on said sample using a CID excitation fluence of sufficient value to disassociate each daughter species completely, but gentle enough not to cause ejection of said ions, whereby all the parent and daughter ions are disassociated to a single progeny ion value;

(c) scanning out all the ions in said trap and integrating the total ion charge to obtain a signal accurately representative of the concentration of said parent ion in said sample.

* * * * *